US010067431B2

(12) United States Patent
Takagi et al.

(10) Patent No.: US 10,067,431 B2
(45) Date of Patent: Sep. 4, 2018

(54) ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Shinji Takagi, Yokohama (JP); Masaki Nonaka, Toride (JP); Haruki Mori, Ichikawa (JP); Ryoichi Tokimitsu, Kashiwa (JP); Koichi Nakata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/495,480

(22) Filed: Apr. 24, 2017

(65) Prior Publication Data

US 2017/0315458 A1 Nov. 2, 2017

(30) Foreign Application Priority Data

Apr. 27, 2016 (WO) ..... PCT/JP2016/063154

(51) Int. Cl.

| | |
|---|---|
| ***G03G 5/07*** | (2006.01) |
| ***G03G 5/147*** | (2006.01) |
| ***G03G 5/047*** | (2006.01) |
| ***G03G 5/05*** | (2006.01) |
| ***G03G 5/06*** | (2006.01) |
| ***G03G 5/10*** | (2006.01) |
| ***G03G 21/18*** | (2006.01) |

(52) U.S. Cl.

CPC ..... *G03G 5/047* (2013.01); *G03G 5/0525* (2013.01); *G03G 5/0614* (2013.01); *G03G 5/0618* (2013.01); *G03G 5/0696* (2013.01); *G03G 5/071* (2013.01); *G03G 5/075* (2013.01); *G03G 5/102* (2013.01); *G03G 5/1473* (2013.01); *G03G 5/14704* (2013.01); *G03G 21/18* (2013.01)

(58) Field of Classification Search

CPC ..... G03G 5/14717; G03G 5/1473; G03G 5/14734; G03G 5/071; G03G 5/078; G03G 5/0525; G03G 5/047

USPC ..... 430/58.7, 58.2, 66, 130, 132, 133

See application file for complete search history.

(56) References Cited

U.S. PATENT DOCUMENTS 8,524,433 B2 * 9/2013 Doi ..... G03G 21/18 430/56

FOREIGN PATENT DOCUMENTS

| | | | |
|---|---|---|---|
| JP | 2001-166510 | A | 6/2001 |
| JP | 2007-79254 | A | 3/2007 |
| JP | 2010-152181 | A | 7/2010 |
| JP | 2012-8503 | A | 1/2012 |
| JP | 2012-8505 | A | 1/2012 |
| JP | 2016-90593 | A | 5/2016 |

OTHER PUBLICATIONS

Diamond, A.S., ed. Handbook of Imaging Materials, Marcel Dekker, Inc., NY (1991), pp. 395-396.*

* cited by examiner

*Primary Examiner* — Janis L Dote

(74) *Attorney, Agent, or Firm* — Canon U.S.A. Inc., IP Division

(57) ABSTRACT

An electrophotographic photosensitive member, in which occurrences of image defects are suppressed, and a method for manufacturing the electrophotographic photosensitive member are provided. In addition, a process cartridge and an electrophotographic apparatus, which include the electrophotographic photosensitive member, are provided. The surface layer of the electrophotographic photosensitive member contains a cured material, and the cured material is a copolymer of a hole transport compound having a chain-polymerizable functional group and a vinyl ester compound containing a long-chain alkyl group.

16 Claims, 3 Drawing Sheets

ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

TECHNICAL FIELD

The present disclosure relates to an electrophotographic photosensitive member, a method for manufacturing the electrophotographic photosensitive member, and a process cartridge and an electrophotographic apparatus, which include the electrophotographic photosensitive member.

BACKGROUND ART

For the purpose of enhancing the durability of an electrophotographic photosensitive member containing an organic photoconductive material (organic electrophotographic photosensitive member), a technology for improving the material and the physical properties of the surface of the electrophotographic photosensitive member has been investigated.

PTL 1 describes a technology for reducing coating film defects and improving the abrasion resistance and the quality of output images (image quality) by disposing, as a surface layer of the electrophotographic photosensitive member, a layer composed of a cured material of a composition containing a hole transport material having a polymerizable functional group and a specific surfactant.

In addition, for the purpose of enhancing the transferability of toner from an electrophotographic photosensitive member to paper or the like and the cleanability of residual toner on the surface of the electrophotographic photosensitive member after having been transferred, a technology for mixing a lubricating material in the surface layer of the electrophotographic photosensitive member has been investigated. PTL 2 describes an electrophotographic photosensitive member including a protective layer formed by using an additive having a reactive functional group.

CITATION LIST

Patent Literature

PTL 1 Japanese Patent Laid-Open No. 2010-152181

PTL 2 Japanese Patent Laid-Open No. 2001-166510

In recent years, regarding an electrophotographic apparatus, it is required to enhance the abrasion resistance of an electrophotographic photosensitive member and further improve the image quality. In particular, a color electrophotographic apparatus has a problem in that streak-like image defects occur due to degradation in the lubricating property of the electrophotographic photosensitive member because of repetitive use. In addition, there is another problem in that image defects occur due to changes in image density associated with fluctuations in electrical potential of the electrophotographic photosensitive member and flaws made on the electrophotographic photosensitive member because of repetitive use likewise. As a result of investigations on the electrophotographic photosensitive members according to PTL 1 and PTL 2 by the present inventors, the above-described image defects occurred in some cases and, therefore, there was room for improvement.

SUMMARY OF INVENTION

It is an object of the present disclosure to provide an electrophotographic photosensitive member, in which occurrences of the above-described image defects are suppressed, and a method for manufacturing the electrophotographic photosensitive member.

In addition, the present disclosure provides a process cartridge and an electrophotographic apparatus which include the above-described electrophotographic photosensitive member.

The present disclosure provides an electrophotographic photosensitive member including a support member and a photosensitive layer on the support member, wherein the surface layer of the electrophotographic photosensitive member contains a cured material, and the cured material is a copolymer of a hole transport compound having a chain-polymerizable functional group and a compound denoted by formula (I) below.

[Chem. 1]

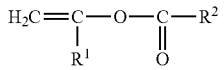

(I)

In formula (I), $R^1$ represents a hydrogen atom or a methyl group, and $R^2$ represents a straight-chain alkyl group having a carbon number of 7 or more or a branched alkyl group having a carbon number of 7 or more.

Also, the present invention provides a method for manufacturing an electrophotographic photosensitive member, including the steps of preparing a surface layer coating liquid containing a hole transport compound having a chain-polymerizable functional group and a compound denoted by formula (I) below, forming a coating film of the surface layer coating liquid, and forming a surface layer of the electrophotographic photosensitive member by curing the coating film.

[Chem. 2]

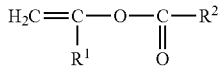

(I)

In formula (I), $R^1$ represents a hydrogen atom or a methyl group, and $R^2$ represents a straight-chain alkyl group having a carbon number of 7 or more or a branched alkyl group having a carbon number of 7 or more.

Also, the present invention provides a process cartridge that is detachably attached to an electrophotographic apparatus main body and integrally supports the above-described electrophotographic photosensitive member and at least one device selected from the group consisting of a charging device, a developing device, a transfer device, and a cleaning device.

Also, the present invention provides an electrophotographic apparatus including the above-described electrophotographic photosensitive member, a charging device, an exposure device, a developing device, and a transfer device.

Further features of the present invention will become apparent from the following description of exemplary embodiments with reference to the attached drawings.

DESCRIPTION OF EMBODIMENTS

Figure 1:
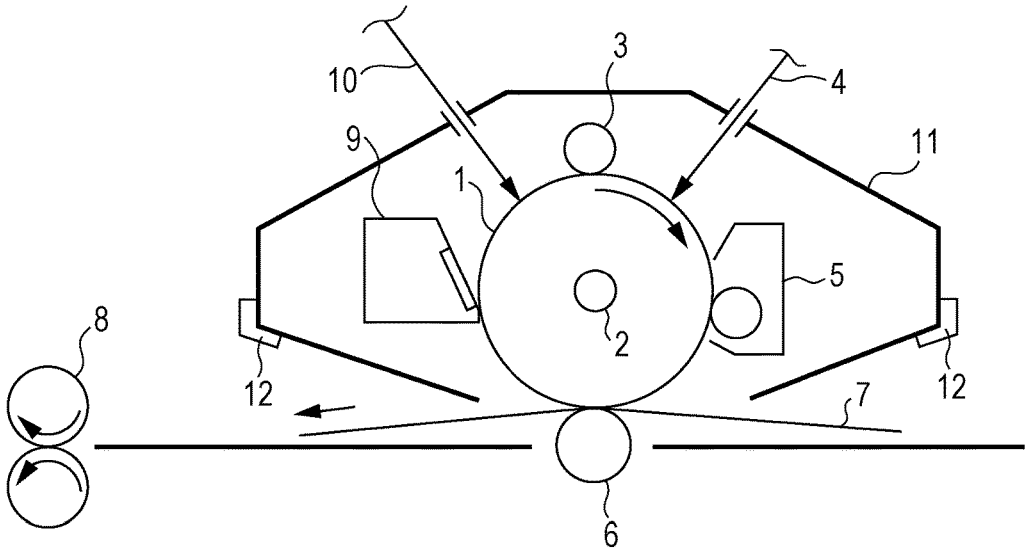
FIG. 1 is a diagram showing an example of the schematic configuration of an electrophotographic apparatus provided with a process cartridge including an electrophotographic photosensitive member.

An electrophotographic photosensitive member according to the present disclosure is an electrophotographic photosensitive member including a support member and a photosensitive layer on the support member. The surface layer of the electrophotographic photosensitive member contains a cured material, and the cured material is a copolymer of a hole transport compound having a chain-polymerizable functional group and a compound (vinyl ester compound containing a long-chain alkyl group) denoted by formula (I) below. The cured material is produced by curing a composition containing the hole transport compound having a chain-polymerizable functional group and the compound denoted by formula (I) below.

[Chem. 3]

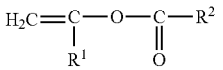

(I)

In formula (I) above, $R^1$ represents a hydrogen atom or a methyl group, and $R^2$ represents a straight-chain alkyl group having a carbon number of 7 or more or a branched alkyl group having a carbon number of 7 or more.

The present inventors estimate that in the case where the electrophotographic photosensitive member has the above-described features, the scratch resistance is enhanced, the durability is enhanced, image defects due to poor lubricity and fluctuations in electrical potential can be suppressed because of the reasons described below.

The electrophotographic photosensitive member including a surface layer containing a cured material that is a polymer of the hole transport compound having a chain-polymerizable functional group has high abrasion resistance of the surface, whereas streak-like image defects easily occur due to the high abrasion resistance. It is estimated that the streak-like image defects occur because behavior of a cleaning device (cleaning blade or the like) becomes unstable due to melt-adhesion of toner and the like to the surface of the electrophotographic photosensitive member.

The behavior of the cleaning device can be stabilized and occurrences of streak-like image defects can be suppressed by using a lubricant, e.g., a fluorine-atom-containing compound or a siloxane compound, for the surface layer of the electrophotographic photosensitive member. It is considered that most of these lubricants have high surface migration properties and tend to be present on the surface of the surface layer of the electrophotographic photosensitive member.

However, as a result of the investigations by the present inventors, it was found that the effect of improving image defects disappeared in some cases where the lubricants having high surface migration properties were used. It is thought that this is due to the lubricant present on only the surface of the surface layer of the electrophotographic photosensitive member being cut by a cleaning device during repetitive use and, thereby, the content of the lubricant near to the surface of the surface layer is reduced.

It is considered that in the present invention, appropriate lubricity can be maintained during repetitive use by mixing the cured material that is a copolymer of the hole transport compound having a chain-polymerizable functional group and the compound denoted by formula (I) above into the surface layer. Then, a structure derived from the compound denoted by formula (I) above is also present inside the surface layer in the depth direction by a polymerization reaction between the chain-polymerizable functional group of the hole transport compound and a vinyl group (C═C group) included in the compound denoted by formula (I) above. Consequently, even when the surface of the surface layer of the electrophotographic photosensitive member is cut by the cleaning device or the like, the lubricity of the surface of the electrophotographic photosensitive member is maintained. It is considered that occurrences of streak-like image defects during repetitive use are suppressed as a result thereof. In addition, in the surface layer of the electrophotographic photosensitive member, the amount of residual chain-polymerizable functional groups (double bond and the like) included in the hole transport compound decreases due to the polymerization reaction (copolymerization reaction) of the two. It is considered that the result thereof is linked to enhancement of the strength (film strength) of the surface layer and enhancement of the scratch resistance of the surface of the electrophotographic photosensitive member. In this regard, in the present invention, the chain-polymerizable functional group refers to a functional group capable of causing chain polymerization. In the case where highly polymerized compound generation reactions are roughly divided into chain polymerization and successive polymerization, the former polymerization reaction form is referred to as the chain polymerization.

The hole transport compound having a chain-polymerizable functional group and the compound denoted by formula (I) above may be of one type or at least two types.

In formula (I) above, $R^2$ represents a straight-chain alkyl group (non-substituted alkyl group) having a carbon number of 7 or more or a branched alkyl group (non-substituted alkyl group) having a carbon number of 7 or more. If the carbon number is less than 7, the lubricating effect is reduced, the blade behavior may become unstable and, thereby, streak-like image defects may occur, as described above.

The chain-polymerizable functional group included in the above-described hole transport compound is a chain-polymerizable functional group copolymerizable with a vinyl group (C═C group) included in the compound denoted by formula (I) above and is preferably a monovalent group having a structure denoted by formula (II) below.

[Chem. 4]

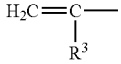

(II)

In formula (II) above, $R^3$ represents a hydrogen atom or a methyl group.

It is preferable that $R^2$ in formula (I) above represent a straight-chain alkyl group (substituted or non-substituted alkyl group) having a carbon number of 9 or more and 14 or less or a branched alkyl group (substituted or non-substituted alkyl group) having a carbon number of 9 or more and 14 or less.

It is preferable that $0.02 \leq Mb/(Ma+Mb) \leq 0.20$ hold, where the mass of the hole transport compound having a chain-polymerizable functional group is specified as Ma and the mass of the compound denoted by formula (I) is specified as Mb. In this range, the durability is higher, the lubricity is high, and fluctuations in electrical potential can be suppressed.

The value of $$\{Ma/(Ma+Mb)\} \times (Fa/M1) + \{Mb/(Ma+Mb)\} \times (1/M2)$$

is preferably 0.0036 or more and 0.0044 or less, where the number of chain-polymerizable functional groups per molecule of the hole transport compound having the above-described chain-polymerizable functional group is specified as Fa, the molecular weight of the hole transport compound having the above-described chain-polymerizable functional group is specified as M1, and the molecular weight of the compound denoted by formula (I) above is specified as M2. Consequently, the durability of the electrophotographic photosensitive member is ensured and, in addition, planing suitable for suppressing occurrences of streak-like image defects can be ensured. Therefore, compatibility between enhancement of the durability of the electrophotographic photosensitive member and suppression of occurrences of image defects can be realized at a higher level.

The cured material contained in the surface layer of the electrophotographic photosensitive member is preferably a copolymer of the hole transport compound having a chain-polymerizable functional group, the compound denoted by formula (I), and the siloxane-modified acrylic compound. Consequently, the lubricity of the surface of the electrophotographic photosensitive member and maintenance thereof are further enhanced, and occurrences of image defects are further suppressed.

The siloxane-modified acrylic compound is a compound in which siloxane is introduced as a side chain into an acrylic polymer, and is produced by, for example, copolymerizing an acrylic monomer and siloxane having an acrylic group.

The amount of the above-described siloxane-modified acrylic compound is preferably 1 part by mass or more and 6 parts by mass or less relative to 100 parts by mass of the total of the hole transport compounds having a chain-polymerizable functional group and the compound denoted by formula (I) above.

Examples of the hole transport group included in the hole transport compound having a chain-polymerizable functional group include groups derived by removing a hydrogen atom from a benzene ring or an alkyl group of triarylamine compounds having an alkyl group as a substituent or having no substituent, groups derived by removing a hydrogen atom from a benzene ring of hydrazone compounds, and groups derived by removing a hydrogen atom from a benzene ring of stilbene compounds.

The hole transport compound having a chain-polymerizable functional group is preferably a compound denoted by formula (III) below.

[Chem. 5]

$$(P^1)_a Z \quad \text{(III)}$$

In formula (III) above, $P^1$ represents a monovalent group denoted by formula (IV) below or a monovalent group denoted by formula (V) below, a represents an integer of 2 or more and 4 or less, in the case where a is 2 or more, $P^1$s, the number of which is a, may be the same or be different from each other, Z represents a hole transport group, and a hydrogen adduct, in which sites bonding to $P^1$s of Z in formula (III) above are substituted with hydrogen atoms, is a compound denoted by formula (VI) below or a compound denoted by formula (VII) below.

[Chem. 6]

(IV)

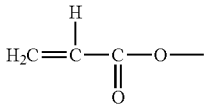

[Chem. 7]

(V)

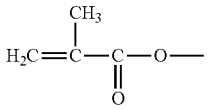

[Chem. 8]

(VI)

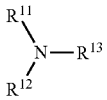

In formula (VI) above, each of $R^{11}$ to $R^{13}$ represents a phenyl group or a phenyl group that has an alkyl group having a carbon number of 1 or more and 6 or less as a substituent.

[Chem. 9]

(VII)

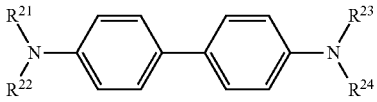

In formula (VII) above, each of $R^{21}$ to $R^{24}$ represents a phenyl group or a phenyl group that has an alkyl group having a carbon number of 1 or more and 6 or less as a substituent.

Specific examples (example compounds) of the hole transport compound having a chain-polymerizable functional group will be described below.

[Chem. 10]

(1-1)

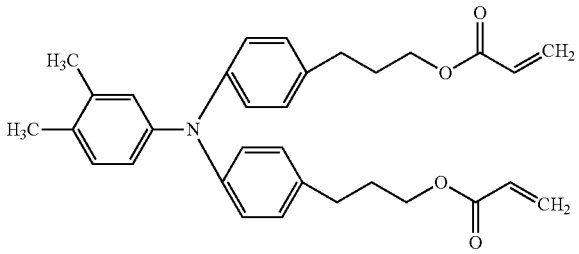

-continued (1-2)

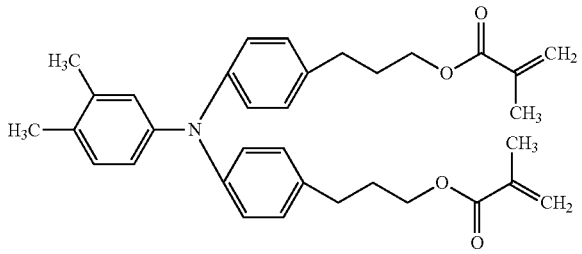

(1-3)

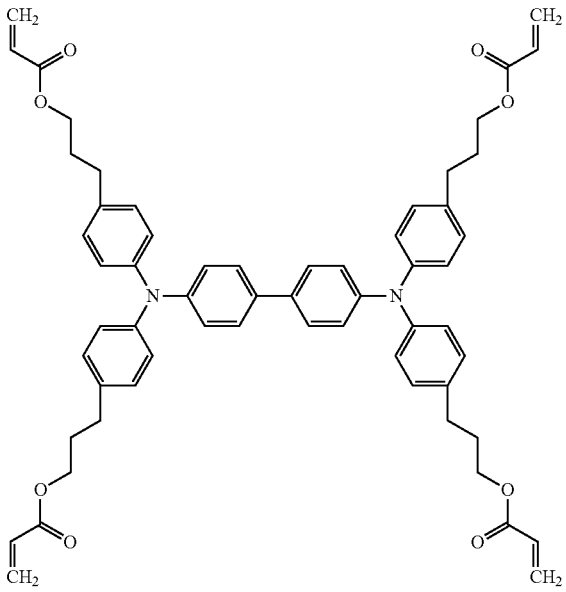

[Chem. 11]

(1-4)

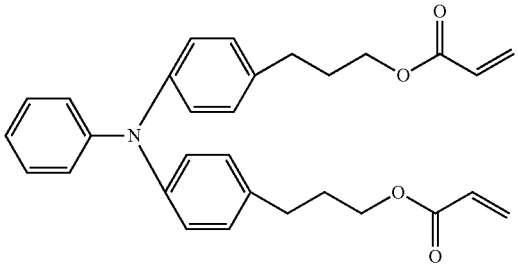

(1-5)

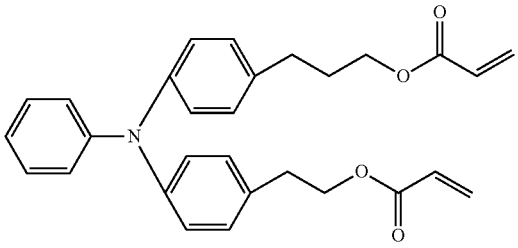

-continued (1-6)

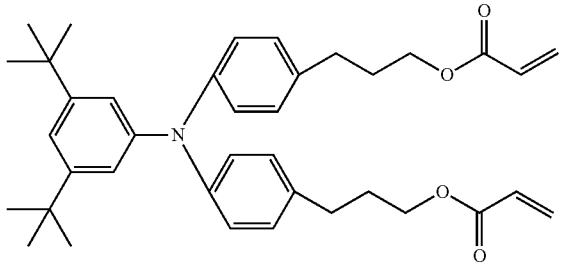

The surface layer of the electrophotographic photosensitive member can be formed by the steps of preparing a surface layer coating liquid containing the hole transport compound having a chain-polymerizable functional group and the compound denoted by formula (I) above, forming a coating film of the surface layer coating liquid, and forming the surface layer of the electrophotographic photosensitive member by curing the coating film.

In the case where the cured material contained in the surface layer of the electrophotographic photosensitive member is a copolymer of the hole transport compound having a chain-polymerizable functional group, the compound denoted by formula (I) above, and the siloxane-modified acrylic compound, the surface layer coating liquid may further contain the siloxane-modified acrylic compound.

Meanwhile, the surface layer coating liquid may contain various additives. Among the various additives, the surface layer coating liquid preferably contains a urea compound from the viewpoint of suppressing degradation due to oxidizing gas.

Also, the surface layer coating liquid may further contain a compound having a chain-polymerizable functional group and not having a hole transport function. In that case, preferably, $$0.02 \leq Mb/(Ma+Mb+Mc) \leq 0.20 \text{ holds,}$$

where the mass of the hole transport compound having a chain-polymerizable functional group, contained in the surface layer coating liquid, is specified as Ma, the mass of the compound denoted by formula (I) above, contained in the surface layer coating liquid, is specified as Mb, and the mass of the compound having a chain-polymerizable functional group and not having a hole transport function, contained in the surface layer coating liquid, is specified as Mc.

Also, the value of $$\{Ma/(Ma+Mb+Mc)\} \times (Fa/M1) + \{Mb/(Ma+Mb+Mc)\} \times (1/M2) + \{Mc/(Ma+Mb+Mc)\} \times (Fc/M3)$$

is preferably 0.0036 or more and 0.0044 or less, where the number of chain-polymerizable functional groups per molecule of the hole transport compound having a chain-polymerizable functional group is specified as Fa, the molecular weight of the hole transport compound having a chain-polymerizable functional group is specified as M1, the molecular weight of the compound denoted by formula (I) above is specified as M2, the number of chain-polymerizable functional groups per molecule of the compound having a chain-polymerizable functional group and not having a hole transport function is specified as Fc, and the molecular weight of the compound having a chain-polymerizable functional group and not having a hole transport function is specified as M3.

In the case where the surface layer is a protective layer, the film thickness thereof is preferably 0.1 μm or more and 15 μm or less, and more preferably 0.5 μm or more and 10 μm or less.

Regarding the solvent used for preparing the surface layer coating liquid, preferably, a solvent that does not dissolve the layer under the surface layer is used. Specifically, alcohol-based solvents, e.g., methanol, ethanol, propanol, isopropanol, 1-butanol, 2-butanol, and 1-methoxy-2-propanol, are preferable.

Examples of measures to cure the coating film of the surface layer coating liquid include methods for performing curing by using heat, ultraviolet rays, and/or electron beams. In order to enhance the strength of the surface layer of the electrophotographic photosensitive member and the durability of the electrophotographic photosensitive member, it is preferable that the coating film be cured by using ultraviolet rays or electron beams.

It is more preferable that the case where the hole transport compound having a chain-polymerizable functional group and the compound denoted by formula (I) above be polymerized by using electron beams, because a very dense (high density) cured material (three-dimensional crosslinked structure) is produced, and the surface layer having higher durability is obtained. In the case where electron beams are radiated, examples of accelerators include a scanning type, an electrocurtain type, a broad beam type, a pulse type, and a laminar type.

In the case where electron beams are used, the acceleration voltage of electron beams is preferably 120 kV or less from the viewpoint of suppressing degradation of material characteristics due to electron beams without impairing the polymerization efficiency. The electron beam absorbed dose of the surface of the coating film of the surface layer coating liquid is preferably 5 kGy or more and 50 kGy or less, and more preferably 1 kGy or more and 10 kGy or less.

Also, in the case where the above-described composition is cured (polymerized) by using electron beams, it is preferable that electron beams be radiated in an inert gas atmosphere and, thereafter, heating be performed in the inert gas atmosphere from the viewpoint of suppressing a polymerization hindrance action due to oxygen. Examples of inert gases include nitrogen, argon, and helium.

It is also preferable that after radiation of ultraviolet rays or electron beams, the electrophotographic photosensitive member be heated to 100° C. or higher and 140° C. or lower. Consequently, a surface layer that has higher durability and suppresses image defects is produced.

More preferably, recessed portions or projected portions are disposed on the surface layer of the electrophotographic photosensitive member for the purpose of further stabilizing the behavior of the cleaning device (cleaning blade) that is brought into contact with the electrophotographic photosensitive member.

The above-described recessed portions or projected portions may be disposed on the entire surface of the electrophotographic photosensitive member or be on part of the surface of the electrophotographic photosensitive member. In the case where the recessed portions or projected portions are disposed on part of the surface of the electrophotographic photosensitive member, the recessed portions or projected portions are disposed in preferably at least the entire region in contact with the cleaning device (cleaning blade).

In the case where recessed portions are formed, the recessed portions can be formed on the surface of the electrophotographic photosensitive member by pressing a mold having projected portions in accordance with the recessed portions against the surface of the electrophotographic photosensitive member and performing shape transfer.

Figure 3:
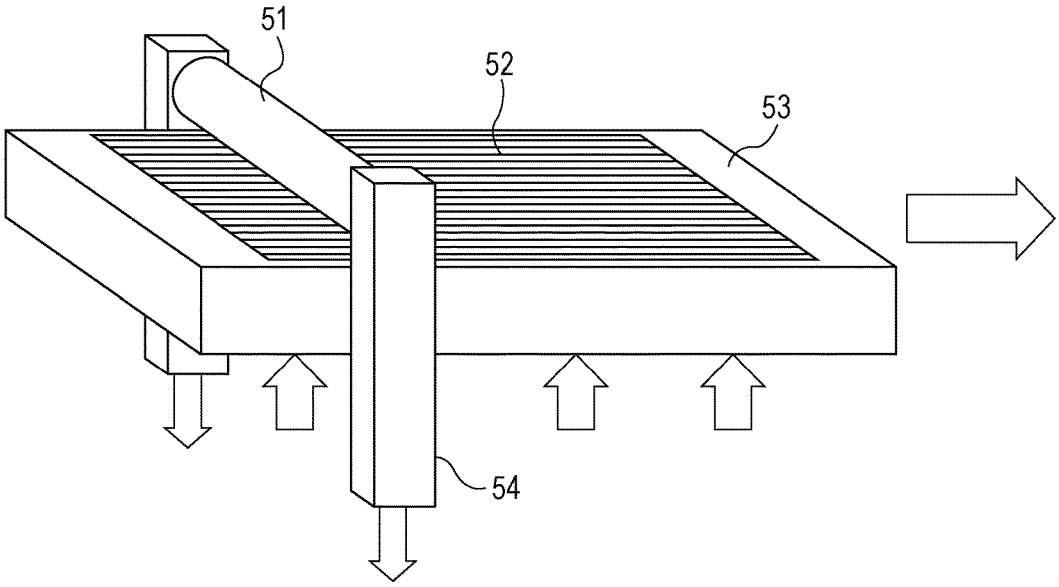
FIG. 3 is a diagram showing an example of a pressure contact shape transfer processing apparatus for forming recessed portions on the surface of an electrophotographic photosensitive member.

FIG. 3 shows a pressure contact shape transfer processing apparatus for forming recessed portions on the surface of the electrophotographic photosensitive member.

According to the pressure contact shape transfer processing apparatus shown in FIG. 3, recessed portions and flat portions can be formed on the surface of an electrophotographic photosensitive member 51 by bringing a mold 52 into continuous contact with the surface (circumferential surface) of the electrophotographic photosensitive member 51 and applying pressure while the electrophotographic photosensitive member 51 that is an object to be processed is rotated.

Examples of materials for forming a pressurizing member 53 include metals, metal oxides, plastics, and glass. In particular, stainless steel (SUS) is preferable from the viewpoint of mechanical strength, dimensional accuracy, and durability. The mold 52 is placed on the upper surface of the pressurizing member 53. In addition, the mold 52 can be brought into contact, at a predetermined pressure, with the surface of the electrophotographic photosensitive member 51 that is supported by the support member 54, by using a support member (not shown in the drawing) and a pressurizing system (not shown in the drawing) disposed on the lower surface side. In this regard, the support member 54 may be pressed against the pressurizing member 53 at a predetermined pressure, or the support member 54 and the pressurizing member 53 may be pressed against each other.

The example shown in FIG. 3 is an example in which the surface of the electrophotographic photosensitive member 51 is continuously processed while the electrophotographic photosensitive member 51 is rotated by the pressurizing member 53 being moved in the direction perpendicular to the shaft direction of the electrophotographic photosensitive member 51 or is driven to rotate. Further, the surface of the electrophotographic photosensitive member 51 can also be continuously processed by fixing the pressurizing member 53 and moving the support member 54 in the direction perpendicular to the shaft direction of the electrophotographic photosensitive member 51, or by moving both the support member 54 and the pressurizing member 53.

In this regard, preferably, the mold 52 and the electrophotographic photosensitive member 51 are heated from the viewpoint of performing shape transfer efficiently.

Examples of the mold 52 include metals and resin films subjected to fine surface processing, silicon wafers and the like provided with patterns on the surfaces by using resists, resin films in which fine particles are dispersed, and metal-coated resin films having fine surface shapes.

In addition, it is preferable that an elastic body be disposed between the mold 52 and the pressurizing member 53 from the viewpoint of equalization of pressure applied for pressing against the electrophotographic photosensitive member 51.

Next, the entire configuration of the electrophotographic photosensitive member according to the present invention will be described.

Electrophotographic Photosensitive Member

The electrophotographic photosensitive member includes a support member and a photosensitive layer on the support member.

Examples of photosensitive layers include a single layer type photosensitive layer containing both a charge generation material and a charge transport material and a laminated-layer-type photosensitive layer in which a charge generation layer containing a charge generation material and a charge transport layer containing a charge transport material are separated from each other. In the present invention, the laminated-layer-type photosensitive layer is preferable.

Figure 2:
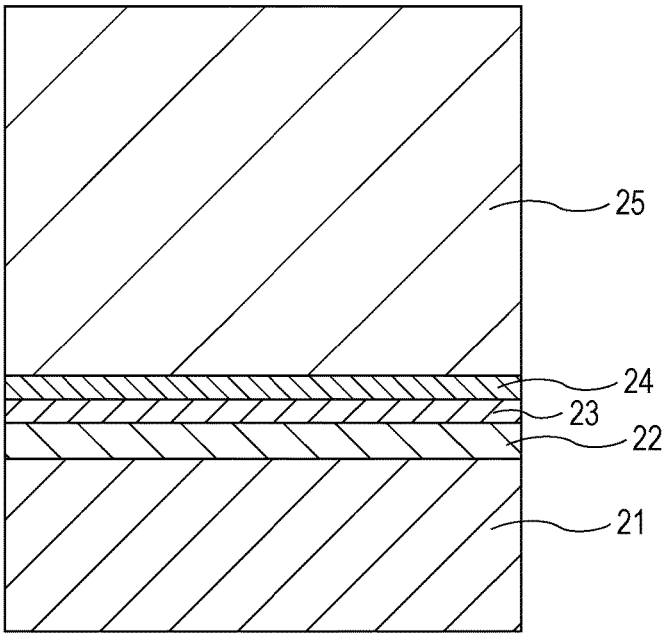
FIG. 2 is a diagram illustrating the layer configuration of an electrophotographic photosensitive member.

FIG. 2 is a diagram showing an example of the layer configuration of the electrophotographic photosensitive member.

In FIG. 2, the electrophotographic photosensitive member includes a support member 21, an undercoat layer 22, a charge generation layer 23, a charge transport layer 24, and a protective layer 25. In this case, the charge generation layer 23 and the charge transport layer 24 constitute a photosensitive layer, and the protective layer is a surface layer. In the case where the protective layer is not provided, the charge transport layer 24 is the surface layer. It is preferable that the protective layer on the charge transport layer serve as the surface layer.

As described above, the surface layer of the electrophotographic photosensitive member contains the cured material that is a copolymer of the hole transport compound having a chain-polymerizable functional group and the compound denoted by formula (I) above.

The electrophotographic photosensitive member according to the present invention will be further described.

Support Member

The support member used for the electrophotographic photosensitive member preferably has electroconductivity (conductive support member). Examples thereof include support members composed of metals or alloys, e.g., iron, copper, gold, silver, aluminum, zinc, titanium, lead, nickel, tin, antimony, indium, chromium, aluminum alloys, and stainless steel. Alternatively, metal support members and resin support members having a coating film formed by vacuum evaporation of aluminum, an aluminum alloy, an indium oxide-tin oxide alloy, or the like can be used. Alternatively, support members formed by impregnating a resin with conductive particles, e.g., carbon black, tin oxide particles, titanium oxide particles, or silver particles, and support members containing a conductive resin can be used. Examples of shapes of the support member include a cylindrical shape, a belt-like shape, a sheet-like shape, and a tabular shape. In the present invention, a cylindrical shape is preferable.

The surface of the support member may be subjected to cutting treatment, surface-roughening treatment, anodic oxide coating treatment, or the like for the purpose of suppressing interference fringes due to scattering of laser light.

A conductive layer may be disposed between the support member and the photosensitive layer or the undercoat layer for the purpose of suppressing interference fringes due to scattering of laser and the like and covering flaws of the support member.

The conductive layer can be formed by applying a conductive layer coating liquid that is produced by subjecting conductive particles, a binder resin, and a solvent to a dispersion treatment so as to form a coating film and drying and/or curing the resulting coating film.

Examples of conductive particles used for the conductive layer include carbon black, acetylene black, particles of metal, e.g., aluminum, nickel, iron, nichrome, copper, zinc, and silver, and particles of metal oxide, e.g., zinc oxide, titanium oxide, tin oxide, antimony oxide, indium oxide, bismuth oxide, and ITO. Alternatively, indium oxide doped with tin or tin oxide doped with antimony or tantalum may be used.

Examples of solvents of the conductive layer coating liquid include ether-based solvents, alcohol-based solvents, ketone-based solvents, and aromatic hydrocarbon solvents. The film thickness of the conductive layer is preferably 0.1 μm or more and 50 μm or less, more preferably 0.5 μm or more and 40 μm or less, and further preferably 1 μm or more and 30 μm or less.

Examples of binder resins used for the conductive layer include polymers and copolymers of vinyl compounds, e.g., styrene, vinyl acetate, vinyl chloride, acrylic acid esters, methacrylic acid esters, vinylidene fluoride, and trifluoroethylene, polyvinyl alcohols, polyvinyl acetals, polycarbonates, polyesters, polysulfones, polyphenylene oxides, polyurethanes, cellulose resins, phenol resins, melamine resins, silicon resins, epoxy resins, and isocyanate resins.

An undercoat layer (intermediate layer) may be disposed between the support member or the conductive layer and the charge generation layer.

The undercoat layer can be formed by applying an undercoat layer coating liquid that is produced by dissolving a binder resin into a solvent so as to form a coating film and drying the resulting coating film.

Examples of binder resins used for the undercoat layer include polyvinyl alcohols, poly-N-vinylimidazoles, polyethylene oxides, ethyl cellulose, ethylene-acrylic acid copolymers, casein, polyamides, N-methoxymethylated 6 nylon resins, copolymer nylon resins, phenol resins, polyurethanes, epoxy resins, acrylic resins, melamine resins, and polyesters.

The undercoat layer may further contain metal oxide particles. Examples thereof include particles containing titanium oxide, zinc oxide, tin oxide, zirconium oxide, and aluminum oxide. Metal oxide particles may also be metal oxide particles in which the surfaces of the metal oxide particles are treated with a surface treatment agent, e.g., a silane coupling agent.

Examples of solvents used for the undercoat layer coating liquid include organic solvents, e.g., alcohol-based solvents, sulfoxide-based solvents, ketone-based solvents, ether-based solvents, ester-based solvents, aliphatic halogenated hydrocarbon-based solvents, and aromatic compounds. The film thickness of the undercoat layer is preferably 0.05 μm or more and 30 μm or less, and more preferably 1 μm or more and 25 μm or less. The undercoat layer may further contain organic resin fine particles and a leveling agent.

In the case of the laminated-layer-type photosensitive layer, the charge generation layer can be formed by applying a charge generation layer coating liquid that is produced by subjecting a charge generation material, a binder resin, and a solvent to mixing and dispersion treatment so as to form a coating film and drying the resulting coating film. Alternatively, the charge generation layer may be an evaporation film of a charge generation material.

Examples of the charge generation material used for the charge generation layer include azo pigments, phthalocyanine pigments, indigo pigments, perylene pigments, polycyclic quinone pigments, squarylium colorants, pyrylium salts, thiapyrylium salts, triphenylmethane colorants, quinacridone pigments, azurenium salt pigments, cyanine dyes, anthanthrone pigments, pyranthrone pigments, xanthene colorants, quinonimine colorants, and stylyl colorants. The charge generation materials may be used alone or at least two types may be used. Among the charge generation materials, phthalocyanine pigments and azo pigments are preferable from the viewpoint of sensitivity. In particular, phthalocyanine pigments are more preferable.

Among the phthalocyanine pigments, in particular, oxytitanium phthalocyanine, chlorogallium phthalocyanine, and hydroxygallium phthalocyanine have excellent charge generation efficiencies. Further, regarding hydroxygallium phthalocyanine, a hydroxygallium phthalocyanine crystal having a crystal form that shows intense peaks at Bragg angles 2θ of 7.4°±0.3° and 28.2°±0.3° in CuKα characteristic X-ray diffraction is more preferable.

Examples of binder resins used for the charge generation layer include polymers of vinyl compounds, e.g., styrene, vinyl acetate, vinyl chloride, acrylic acid esters, methacrylic acid esters, vinylidene fluoride, and trifluoroethylene, polyvinyl alcohols, polyvinyl acetals, polycarbonates, polyesters, polysulfones, polyphenylene oxides, polyurethanes, cellulose resins, phenol resins, melamine resins, silicon resins, and epoxy resins.

The mass ratio of the charge generation material to the binder resin (charge generation material:binder resin) is preferably within the range of 1:0.3 to 1:4.

Examples of dispersion treatment methods include methods using a homogenizer, ultrasonic dispersion, a ball mill, a vibrating ball mill, a sand mill, an attritor, and a roll mill.

Examples of solvents used for the charge generation layer coating liquid include alcohol-based solvents, sulfoxide-based solvents, ketone-based solvents, ether-based solvents, ester-based solvents, aliphatic halogenated hydrocarbon-based solvents, and aromatic compounds.

The film thickness of the charge generation layer is preferably 0.01 μm or more and 5 μm or less, and more preferably 0.1 μm or more and 1 μm or less. In this regard, as necessary, various sensitizing agents, antioxidants, ultraviolet absorbers, and plasticizers can be added to the charge generation layer.

Next, the charge transport layer will be described. The charge transport layer is formed on the charge generation layer. The charge transport layer can be formed by applying a charge transport layer coating liquid that is produced by dissolving a charge transport material and a binder resin into a solvent so as to form a coating film and drying the resulting coating film.

Examples of binder resins used for the charge transport layer include polyvinyl butyrals, polycarbonates, polyesters, phenoxy resins, polyvinyl acetates, acrylic resins, polyacrylamides, polyamides, polyvinylpyridines, cellulose resins, urethane resins, and epoxy resins. Polycarbonates are preferable.

Examples of charge transport materials used for the charge transport layer include triarylamine compounds, hydrazone compounds, stilbene compounds, pyrazoline compounds, oxazole compounds, triarylmethane compounds, and thiazole compounds. The charge transport materials may be used alone or at least two types may be used.

Regarding the ratio of the charge transport material to the binder resin in the charge transport layer, the charge transport material is preferably 0.3 parts by mass or more and 10 parts by mass or less relative to 1 part by mass of the binder resin.

Incidentally, from the viewpoint of suppressing cracking of the charge transport layer, the drying temperature is preferably 60° C. or higher and 150° C. or lower, and more preferably 80° C. or higher and 120° C. or lower. Also, the drying time is preferably 10 minutes or more and 60 minutes or less.

Examples of solvents used for the charge transport layer coating liquid include alcohol solvents, sulfoxide solvents, ketone solvents, ether solvents, ester solvents, aliphatic halogenated hydrocarbon solvents, and aromatic hydrocarbon solvents.

The film thickness of the charge transport layer is preferably 5 μm or more and 40 μm or less, and more preferably 10 μm or more and 35 μm or less.

In this regard, as necessary, antioxidants, ultraviolet absorbers, plasticizers, metal oxide particles, and inorganic particles can be added to the charge transport layer. Also, fluorine-atom-containing resin particles, silicone-containing resin particles, and the like may be included.

Then, in the case where the protective layer is the surface layer of the electrophotographic photosensitive member, the protective layer can be formed by preparing a surface layer coating liquid containing the hole transport compound having a chain-polymerizable functional group and a compound denoted by formula (I) above, forming a coating film of the surface layer coating liquid on the charge transport layer, and curing the resulting coating film, as described above.

In the case where each of the above-described layers is coated with the coating liquid, a coating method, such as a dip coating method, a spray coating method, a ring coating method, a spin coating method, a roller coating method, a Mayer bar coating method, or a blade coating method can be used.

Next, FIG. 1 shows an example of the schematic configuration of an electrophotographic apparatus provided with the process cartridge including the electrophotographic photosensitive member.

In FIG. 1, a cylindrical electrophotographic photosensitive member 1 is driven to rotate about a shaft 2 in the direction indicated by the arrow at a predetermined circumferential velocity. The surface (circumferential surface) of the electrophotographic photosensitive member 1 is positively or negatively charged by a charging device (primary charging device) 3 in the process of rotation. Subsequently, the surface of the electrophotographic photosensitive member 1 is irradiated with exposure light 4 (image exposure light) output from an exposure device (image exposure device) (not shown in the drawing). The intensity of the exposure light 4 is modulated in accordance with the time-series electric digital image signals of the target image information. Examples of exposure devices include slit exposure and laser beam scanning exposure. In this manner, a latent image in accordance with the target image information is formed on the surface of the electrophotographic photosensitive member 1.

The latent image formed on the surface of the electrophotographic photosensitive member 1 is developed (normal development or reversal development) with a toner accommodated in a developing device 5 so as to form a toner image. The toner image formed on the surface of the electrophotographic photosensitive member 1 is transferred to a transfer medium 7 by the transfer device 6. Here, in the case where the transfer medium 7 is paper, the paper is taken from a sheet feeder (not shown in the drawing) in synchronization with the rotation of the electrophotographic photosensitive member 1 and is fed between the electrophotographic photosensitive member 1 and the transfer device 6. Incidentally, a bias voltage with polarity opposite to the polarity of the charge carried by the toner is applied from a bias power supply (not shown in the drawing) to the transfer device 6. In this regard, the transfer device may be an intermediate transfer type transfer device including a primary transfer member, an intermediate transfer body, and a secondary transfer member.

The transfer medium 7 provided with a transferred toner image is separated from the surface of the electrophotographic photosensitive member 1 and is conveyed to a fixing device 8 so as to be subjected to treatment for fixing the toner image and be printed, as an image-formed material (print, copy), outside the electrophotographic apparatus.

The surface of the electrophotographic photosensitive member 1 after the toner image is transferred is cleaned by a cleaning device 9 so as to remove deposits, e.g., transfer-residual toner. The transfer-residual toner can also be recovered by the developing device and the like. Further, as necessary, the surface of the electrophotographic photosensitive member 1 is subjected to static elimination treatment by radiation of the pre-exposure light 10 from the pre-exposure device (not shown in the drawing) and, thereafter, is repeatedly used for image formation. Incidentally, in the case where the charging device 3 is a contact charging device using a charging roller and the like, the pre-exposure device is not always necessary.

Among the above-described constituents, e.g., the electrophotographic photosensitive member 1, the charging device 3, the developing device 5, the transfer device 6, and the cleaning device 9, a plurality of constituents are selected and accommodated into a container so as to be integrally supported as a process cartridge. The process cartridge may be configured to be detachably attached to an electrophotographic apparatus main body, e.g., a copier and a laser beam printer. In FIG. 1, the electrophotographic photosensitive member 1, the charging device 3, the developing device 5, and the cleaning device 9 are integrally supported and are made into a cartridge. Then, a process cartridge 11 is detachably attached to the electrophotographic apparatus main body by using a guide device 12, e.g., rails, of the electrophotographic apparatus main body.

EXAMPLES

The present disclosure will be described below in more detail with reference to specific examples. In this regard, "part" in the examples refers to "part by mass".

Example 1

An aluminum cylinder having a diameter of 30 mm, a length of 357.5 mm, and a thickness of 1 mm was specified as a support member (conductive support member).

Subsequently, 100 parts of zinc oxide particles (specific surface area: 19 $m^2/g$, powder resistivity: $4.7\times16^6$ Ω·cm) and 500 parts of toluene were mixed under agitation, 0.8 parts of silane coupling agent was added thereto, and agitation was performed for 6 hours. Thereafter, toluene was removed by distillation under reduced pressure, and heat-drying was performed at 130° C. for 6 hours so as to produce surface-treated zinc oxide particles. KBM602 (compound name: N-2-(aminoethyl)-3-aminopropylmethyldimethoxysilane) produced by Shin-Etsu Chemical Co., Ltd., was used as the silane coupling agent.

Then, polyol was produced by dissolving 15 parts of polyvinylbutyral (weight average molecular weight: 40,000, trade name: BM-1, produced by Sekisui Chemical Co., Ltd.) and 15 parts of blocked isocyanate (trade name: SUMIDUR 3175, produced by Sumika Bayer Urethane Co., Ltd.) into a mixed solution of 73.5 parts of methyl ethyl ketone and 73.5 parts of 1-butanol. The resulting solution was mixed with 80.8 parts of the above-described surface-treated zinc oxide particles and 0.8 parts of 2,3,4-trihydroxybenzophenone (produced by TOKYO KASEI KOGYO CO., LTD.), and this was dispersed by a sand mill apparatus using glass beads having a diameter of 0.8 mm in an atmosphere at 23° C.±3° C. for 3 hours. After dispersion, 0.01 parts of silicone oil (trade name: SH28PA, produced by Dow Corning Toray Silicone Co., Ltd.) and 5.6 parts of crosslinked polymethyl methacrylate (PMMA) particles (trade name: TECHPOLYMER SSX-103, produced by Sekisui Chemical Co., Ltd., average primary particle diameter of 3 μm) were added and agitation was performed so as to prepare an undercoat layer coating liquid.

The above-described aluminum cylinder was dip-coated with the resulting undercoat layer coating liquid so as to form a coating film, and the resulting coating film was dried for 40 minutes at 160° C. so as to form an undercoat layer having a film thickness of 18 μm.

Subsequently, a hydroxygallium phthalocyanine crystal having a crystal form that shows intense peaks at Bragg angles 2θ±0.2° of 7.4° and 28.2° in CuKα characteristic X-ray diffraction was prepared. Dispersion of 20 parts of the hydroxygallium phthalocyanine crystal, 0.2 parts of a compound denoted by formula (2) below, 10 parts of polyvinylbutyral (trade name: S-LEC BX-1, produced by Sekisui Chemical Co., Ltd.), and 600 parts of cyclohexanone was performed by a sand mill apparatus using glass beads having a diameter of 1 mm for 4 hours. Thereafter, 700 parts of ethyl acetate was added so as to prepare a charge generation layer coating liquid. The undercoat layer was dip-coated with the resulting charge generation layer coating liquid so as to form a coating film, and the resulting coating film was heat-dried in an oven at a temperature of 80° C. for 15 minutes so as to form a charge generation layer having a film thickness of 0.17 μm.

[Chem. 12]

(2)

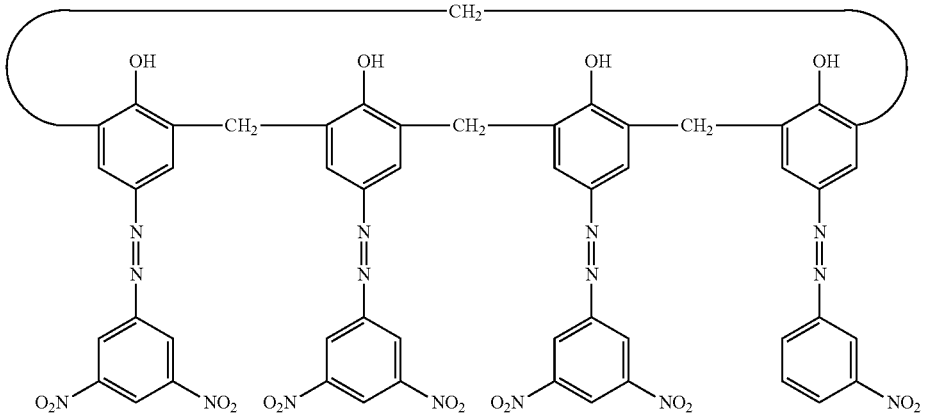

Then, 30 parts of a compound (charge transport material) denoted by formula (3) below, 60 parts of a compound (charge transport material) denoted by formula (4) below, 10 parts of a compound denoted by formula (5) below, 100 parts of polycarbonate (trade name: IUPILON Z400, produced by Mitsubishi Engineering-Plastics Corporation, bisphenol Z type), and 0.02 parts of polycarbonate (viscosity average molecular weight Mv: 20,000) having a structural unit denoted by formula (6-1) below and a structural unit denoted by formula (6-2) below were dissolved into a solvent composed of 600 parts of mixed xylene and 200 parts of dimethoxymethane so as to prepare a charge transport layer coating liquid. The charge generation layer was dip-coated with the resulting charge transport layer coating liquid so as to form a coating film, and the resulting coating film was dried for 30 minutes at 100° C. so as to form a charge transport layer having a film thickness of 18 μm.

[Chem. 13]

(3)

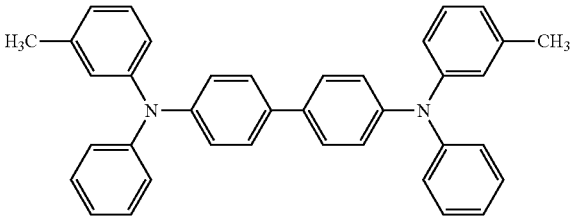

(4)

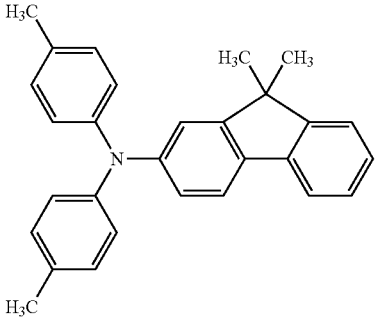

(5)

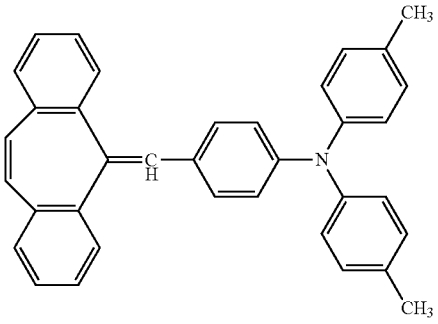

[Chem. 14]

(6-1)

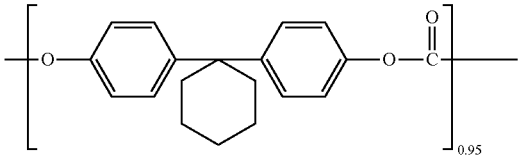

-continued (6-2)

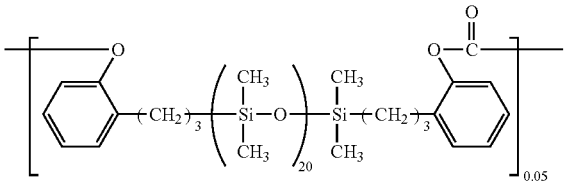

(In formulae (6-1) and (6-2), each of 0.95 and 0.05 is a molar ratio (copolymerization ratio) of the two structural units.)

Subsequently, 95 parts of example compound (1-1) above, 5 parts of vinyl ester compound that is a compound denoted by formula (7) below (produced by TOKYO KASEI KOGYO CO., LTD.), 3.5 parts of siloxane-modified acrylic compound (BYK-3550, produced by BYK Japan KK), 5 parts of urea compound denoted by formula (8) below, 200 parts of 1-propanol, and 100 parts of 1,1,2,2,3,3,4-heptafluorocyclopentane (trade name: ZEORORA H, produced by ZEON Corporation) were mixed and agitation was performed. Thereafter, the resulting solution was filtrated by a POLYFLON filter (trade name: PF-020, produced by Advantec Toyo Kaisha, Ltd.) so as to prepare a surface layer coating liquid (protective layer coating liquid).

[Chem. 15]

(7)

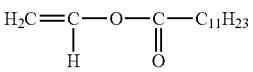

[Chem. 16]

(8)

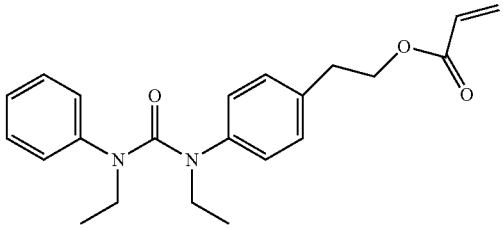

The charge transport layer was dip-coated with the resulting surface layer coating liquid so as to form a coating film, and the resulting coating film was dried for 10 minutes at 50° C. Thereafter, the coating film was irradiated with electron beams for 1.6 seconds in a nitrogen atmosphere under the conditions of an acceleration voltage of 70 kV and a beam current of 5.0 mA while the support member (body to be irradiated) was rotated at a velocity of 200 rpm. In this regard, the absorbed dose of the electron beams at this time measured 15 kGy. Then, in a nitrogen atmosphere, the coating film was heated over 30 seconds until the temperature of the coating film increased from 25° C. to 117° C. The oxygen concentration was 15 ppm or less during the electron beam irradiation and the heat treatment thereafter. Subsequently, the coating film was naturally cooled to a temperature of 25° C. in air, and heat treatment was performed for 30 minutes under the condition, in which the temperature of the coating film reached 105° C., so as to form a protective layer (surface layer) having a film thickness of 5 μm.

In this manner, an electrophotographic photosensitive member including the protective layer before formation of recessed portions was produced.

Next, a pattern member (mold) was set in a pressure contact shape transfer processing apparatus, and the resulting electrophotographic photosensitive member before formation of recessed portions was subjected to surface processing.

Figure 4A:
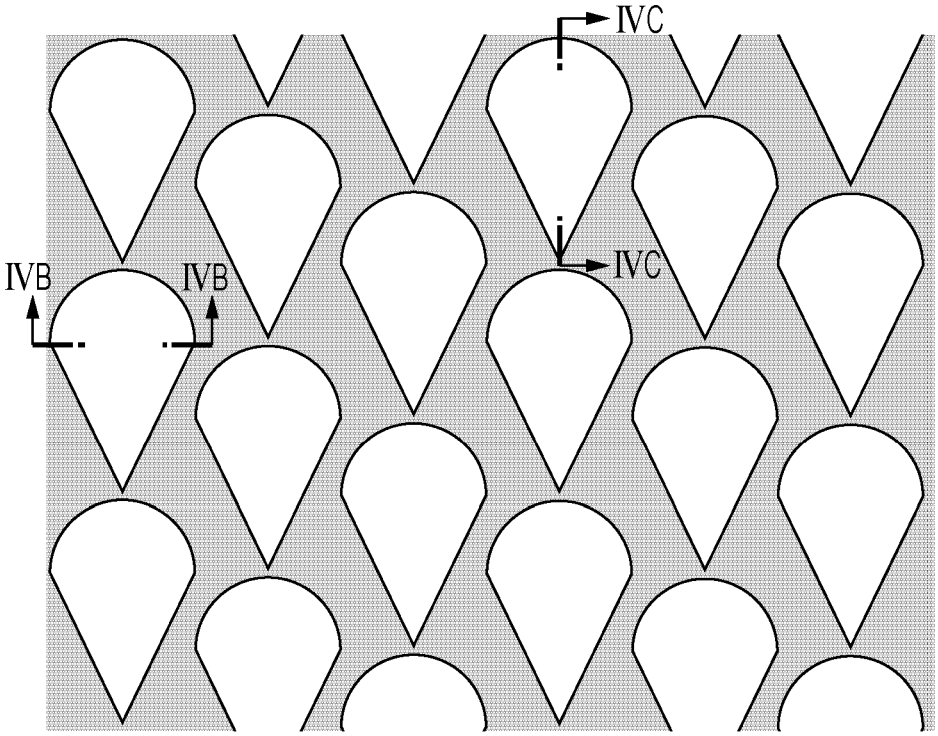
FIGS. 4A to 4C show a top view and sectional views of a mold used in the examples and the comparative examples.
Figure 4B:
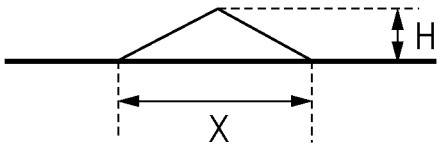
Figure 4C:
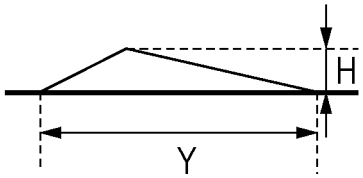

Specifically, a mold shown in FIGS. 4A to 4C was set in a pressure contact shape transfer processing apparatus having the configuration roughly shown in FIG. 3, and the resulting electrophotographic photosensitive member before formation of recessed portions was subjected to surface-processing. FIGS. 4A to 4C are diagrams showing the mold used in the examples and comparative examples. FIG. 4A is a top view schematically showing the mold, and FIG. 4B is a schematic sectional view of a projected portion of the mold in the shaft direction of the electrophotographic photosensitive member (sectional view of a cross section along the line IVB-IVB in FIG. 4A). FIG. 4C is a sectional view of a projected portion of the mold in the circumferential direction of the electrophotographic photosensitive member (sectional view of a cross section along the line IVC-IVC in FIG. 4A). The mold shown in FIGS. 4A to 4C has a projected shape, where the maximum width (the maximum width, in the shaft direction of the electrophotographic photosensitive member, of the projected portion on the mold when viewed from above) X: 30 μm, the maximum length (the maximum length, in the circumferential direction of the electrophotographic photosensitive member, of the projected portion on the mold when viewed from above) Y: 75 μm, the area ratio of 56%, and the height H: 2 μm). In this regard, the area ratio refers to the proportion of the area of projected portions in the entire surface when the mold is viewed from above. The temperatures of the electrophotographic photosensitive member and the mold were controlled such that the temperature of the surface of the electrophotographic photosensitive member became 120° C. during processing. Then, the electrophotographic photosensitive member was rotated in the circumferential direction while the electrophotographic photosensitive member and a pressurizing member were pressed against the mold, and recessed portions were formed on the entire surface of the surface layer (circumferential surface) of the electrophotographic photosensitive member. In this manner, the electrophotographic photosensitive member was produced.

The surface of the resulting electrophotographic photosensitive member was observed under magnification by using a laser microscope (produced by KEYENCE CORPORATION, trade name: X-100) with a 50× lens, and the recessed portions disposed on the surface of the electrophotographic photosensitive member were observed. In the observation, adjustment was performed such that the electrophotographic photosensitive member was not inclined in the longitudinal direction and, in the circumferential direction, the top of the arc of the electrophotographic photosensitive member came into focus. The images observed under magnification were connected by using image connection application so as to obtain a square region with a side of 500 μm. Then, regarding the obtained results, attached image analysis software was used, image processing height data were selected, and filtration treatment was performed by using the filter type median.

As a result of the above-described observation, the depth of the recessed portion was 1 μm, the width of the opening portion in the shaft direction was 30 μm, the length of the opening portion in the circumferential direction was 75 μm, and the area was 140,000 $\mu m^2$. In this regard, the area refers to the area of the recessed portions when the surface of the electrophotographic photosensitive member was viewed from above and refers to the area of the opening portions of the recessed portions.

Meanwhile, the resulting electrophotographic photosensitive member was mounted on a cyan station of a modified machine of an electrophotographic apparatus (copier) (trade name: IR-ADV C5051), serving as an evaluation apparatus, produced by CANON KABUSHIKI KAISHA, and image evaluation was performed at 30° C. and 80% RH.

Regarding the image evaluation, initially, the total amount of discharge current in the charging step was set to be 100 μA, and a cassette heater (drum heater) in the apparatus was turned off. Thereafter, a test chart with an image ratio of 5% was used, and 2,000 sheets of images were continuously formed. Subsequently, an A4-size landscape image with a 600-dpi output resolution and a 17-step gradation was formed, and the resulting full A4-size image was evaluated as described below.

A: Neither vertical streak nor image deletion is observed, and image reproducibility is good.

B: A vertical streak or image deletion is slightly observed, but image reproducibility of the other portion is good.

C: In the case of observation under magnification, defects are observed to a small extent, but image reproducibility is good.

D: A vertical streak or image deletion is clearly observed, and image reproducibility is poor.

Then, a test chart with an image ratio of 5% was used, and 5,000 sheets of images were continuously formed. After the image formation was finished and 3 days elapsed with no operation, an A4-size landscape image with a 600-dpi output resolution and a 17-step gradation was formed, and the resulting image on the entire surface of A4-size paper was evaluated in the same manner as that described above.

In addition, Surface Surfcorder SE3500 produced by Kosaka Laboratory Ltd., was used, the surface roughness (maximum height Rmax) of the electrophotographic photosensitive member after 50,000 sheets of continuous image formation under the conditions of cutoff of 0.8 mm, the measuring length of 8 mm, and the measuring speed of 0.5 mm/s was determined, and the resulting Rmax value was specified as "flaw depth".

Separately, 1,000 sheets of continuous image formation was performed under the same conditions so as to examine fluctuations in electrical potential of the electrophotographic photosensitive member. Regarding the value, a difference between the potential after 1,000 sheets and the potential at the initial stage of each of an image exposure portion VL and a non-exposure portion VD was calculated.

The results are shown in Table 1. In this regard, "potential after 1,000 sheets−potential at initial stage" of the image exposure portion VL is expressed as ΔVL, and "potential after 1,000 sheets−potential at initial stage" of the non-exposure portion VD is expressed as ΔVD.

Example 2

An electrophotographic photosensitive member was produced in the same manner as example 1 except that the compound denoted by formula (7) above was changed to a compound denoted by formula (9) below, and evaluation was performed.

[Chem. 17]

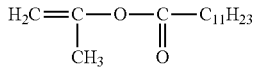

(9)

Example 3

An electrophotographic photosensitive member was produced in the same manner as example 1 except that the siloxane-modified acrylic compound was not used when the surface layer coating liquid was prepared, and evaluation was performed.

Example 4

An electrophotographic photosensitive member was produced in the same manner as example 3 except that 95 parts of example compound (1-1) above was changed to 85 parts of example compound (1-5) above and 5 parts of the compound denoted by formula (7) above was changed to 15 parts of a compound denoted by formula (10) below, and evaluation was performed.

[Chem. 18]

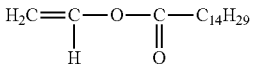

(10)

Example 5

An electrophotographic photosensitive member was produced in the same manner as example 3 except that 95 parts of example compound (1-1) above was changed to 80 parts of example compound (1-6) above and 5 parts of the compound (7) was changed to 20 parts, and evaluation was performed.

Example 6

An electrophotographic photosensitive member was produced in the same manner as example 4 except that example compound (1-5) above was changed to 95 parts and the compound denoted by formula (10) above was changed to 5 parts, and evaluation was performed.

Example 7

An electrophotographic photosensitive member was produced in the same manner as example 5 except that example compound (1-6) above was changed to 95 parts and the compound denoted by formula (7) above was changed to 5 parts, and evaluation was performed.

Example 8

An electrophotographic photosensitive member was produced in the same manner as example 5 except that the compound denoted by formula (7) above was changed to the compound denoted by formula (10) above, and evaluation was performed.

Example 9

An electrophotographic photosensitive member was produced in the same manner as example 5 except that example compound (1-6) above was changed to 98 parts and the compound denoted by formula (7) above was changed to 2 parts, and evaluation was performed.

Example 10

An electrophotographic photosensitive member was produced in the same manner as example 8 except that example compound (1-6) above was changed to 75 parts and the compound denoted by formula (10) above was changed to 25 parts, and evaluation was performed.

Example 11

An electrophotographic photosensitive member was produced in the same manner as example 5 except that example compound (1-6) above was changed to 99 parts and the compound denoted by formula (7) above was changed to 1 part, and evaluation was performed.

Example 12

An electrophotographic photosensitive member was produced in the same manner as example 11 except that the compound denoted by formula (7) above was changed to a compound denoted by formula (11) below, and evaluation was performed.

[Chem. 19]

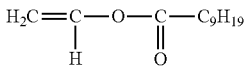

(11)

Example 13

An electrophotographic photosensitive member was produced in the same manner as example 10 except that the compound denoted by formula (10) above was changed to a compound (12) denoted by formula (12) below, and evaluation was performed.

[Chem. 20]

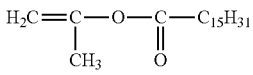

(12)

Example 14

An electrophotographic photosensitive member was produced in the same manner as example 12 except that the compound denoted by formula (11) above was changed to a compound denoted by formula (13) below, and evaluation was performed.

[Chem. 21]

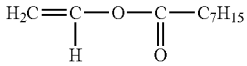

(13)

Example 15

An electrophotographic photosensitive member was produced in the same manner as example 1 except that 95 parts of example compound (1-1) above was changed to 70 parts of hole transport compound denoted by formula (1-7) below and when the surface layer coating liquid was prepared, 25 parts of trimethylolpropane triacrylate (trade name: TMPTA, produced by Daicel-Cytec Co., Ltd.) was added, and evaluation was performed.

[Chem. 22]

(1-7)

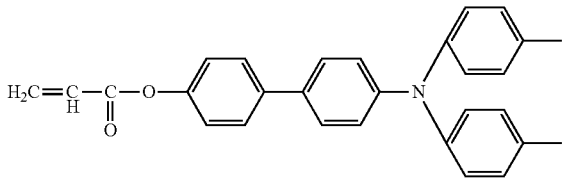

Example 16

An electrophotographic photosensitive member was produced in the same manner as example 1 except that the surface layer was formed as described below, and evaluation was performed.

Mixing and agitation of 95 parts of example compound (1-1) above, 5 parts of compound denoted by formula (7) above (produced by TOKYO KASEI KOGYO CO., LTD.), 3.5 parts of siloxane-modified acrylic compound (trade name: BYK-3550, produced by BYK Japan KK), 15 parts of 2,4-diethylthioxantone serving as a photopolymerization initiator, 5 parts of 4,4'-bis(diethylamino)benzophenone serving as a polymerization initiator auxiliary agent, 200 parts of 1-propanol, and 100 parts of 1,1,2,2,3,3,4-heptafluorocyclopentane (trade name: ZEORORA H, produced by ZEON Corporation) were performed. Thereafter, the resulting solution was filtrated by using a POLYFLON filter (trade name: PF-020, produced by Advantec Toyo Kaisha, Ltd.) so as to prepare a surface layer coating liquid.

Subsequently, the charge transport layer was dip-coated with the resulting surface layer coating liquid so as to form a coating film, and the resulting coating film was subjected to photo-curing by being irradiated with ultraviolet rays for 30 seconds at light intensity of $1.20\times10^{-5}$ W/m$^2$ by using a metal halide lamp. Thereafter, the resulting coating film was heat-dried at 120° C. for 1 hour and 40 minutes so as to form a surface layer having a film thickness of 5 μm.

Example 17

An electrophotographic photosensitive member was produced in the same manner as example 1 except that the charge transport layer was dip-coated with the surface layer coating liquid so as to form a coating film and heating was performed at 150° C. for 1 hour in an atmosphere having an oxygen concentration of 200 ppm so as to form a surface layer having a film thickness of 5 μm, and evaluation was performed.

Example 18

An electrophotographic photosensitive member was produced in the same manner as example 1 except that after the coating film was irradiated with electron beams, the coating film was heated over 30 seconds in a nitrogen atmosphere until the temperature of the coating film increased from 25° C. to 140° C., and evaluation was performed.

Example 19

An electrophotographic photosensitive member was produced in the same manner as example 1 except that after the coating film was irradiated with electron beams, the coating film was heated over 30 seconds in a nitrogen atmosphere until the temperature of the coating film increased from 25° C. to 100° C., and evaluation was performed.

Example 20

An electrophotographic photosensitive member was produced in the same manner as example 1 except that after the coating film was irradiated with electron beams, the coating film was heated over 30 seconds in a nitrogen atmosphere until the temperature of the coating film increased from 25° C. to 150° C., and evaluation was performed.

Example 21

An electrophotographic photosensitive member was produced in the same manner as example 1 except that after the coating film was irradiated with electron beams, the coating film was heated over 30 seconds in a nitrogen atmosphere until the temperature of the coating film increased from 25° C. to 90° C., and evaluation was performed.

Example 22

An electrophotographic photosensitive member was produced in the same manner as example 1 except that 1-propanol used for the surface layer coating liquid was changed to tetrahydrofuran and the coating film was formed on the charge transport layer by performing spray coating, and evaluation was performed.

Comparative Example 1

An electrophotographic photosensitive member was produced in the same manner as example 6 except that the compound denoted by formula (10) above was not used when the surface layer coating liquid (protective layer coating liquid) was prepared, and evaluation was performed.

As a result of evaluation, the streak image levels at the initial stage and after 50,000 sheets of image formation were degraded and a deeper flaw was generated on the surface of the electrophotographic photosensitive member in comparison with those in example 6.

Comparative Example 2

An electrophotographic photosensitive member was produced in the same manner as example 6 except that the compound denoted by formula (10) above was changed to a surfactant including a structure in which an acrylic monomer containing a fluorine atom was polymerized (trade name: KL-600, produced by Kyoeisha Chemical Co., Ltd.), and evaluation was performed.

As a result of evaluation, in particular, the streak image level after 50,000 sheets of image formation was degraded in comparison with that in example 6. The reason for this is considered to be that the surfactant migrated to the surface of the electrophotographic photosensitive member and disappeared at the initial stage of the endurance.

Comparative Example 3

An electrophotographic photosensitive member was produced in the same manner as example 6 except that the compound denoted by formula (10) above was changed to a compound denoted by formula (14) above, and evaluation was performed.

[Chem. 23]

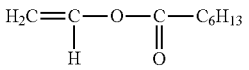

(14)

As a result of evaluation, the streak image levels at the initial stage and after 50,000 sheets of image formation were degraded in comparison with those in example 6. The reason for this is considered to be that the carbon number of the alkyl group is small and, thereby, a lubricating effect is small.

As a result of evaluation, in the examples, streak-like image defects at the initial stage and in repetitive use were sufficiently suppressed, and other image problems, e.g., density variations, did not occur. In the comparative examples, streak-like image defects or image defects due to density variations occurred.

The present invention is not limited to the above-described embodiments and can be variously changed and modified without departing from the spirit and scope of the disclosure.

According to the present disclosure, an electrophotographic photosensitive member, in which occurrences of the above-described image defects are suppressed, and a method for manufacturing the electrophotographic photosensitive member can be provided.

In addition, according to the present disclosure, an electrophotographic apparatus and a process cartridge, which include the above-described electrophotographic photosensitive member, can be provided.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2016/063154, filed Apr. 27, 2016, which is hereby incorporated by reference herein in its entirety.

TABLE 1

| | Hole transport compound | Compound denoted by formula (1) | Addition amount ratio (Mb/(Ma + Mb)) | {Ma/(Ma + Mb)} × (Fa/M1) + {Mb/(Ma + Mb)} × (1/M2) | Fluctuations in electrical potential ΔVD | Fluctuations in electrical potential ΔVL | Level of 17-step gradation image: Initial stage | Level of 17-step gradation image: After 50,000 sheets of endurance | Flow depth (μm): After 50,000 sheets of endurance |
|---|---|---|---|---|---|---|---|---|---|
| Example 1 | (1-1) | compound (7) | 0.05 | 0.0040 | +1 | +2 | A | A | 0.82 |
| Example 2 | (1-1) | compound (9) | 0.05 | 0.0040 | −1 | +2 | A | A | 0.81 |
| Example 3 | (1-1) | compound (7) | 0.05 | 0.0040 | 0 | +2 | A | B | 0.83 |
| Example 4 | (1-5) | compound (10) | 0.15 | 0.0044 | −3 | +4 | A | B | 0.81 |
| Example 5 | (1-6) | compound (7) | 0.20 | 0.0036 | −4 | +3 | A | B | 0.90 |
| Example 6 | (1-5) | compound (10) | 0.05 | 0.0045 | −2 | +4 | B | B | 0.80 |
| Example 7 | (1-6) | compound (7) | 0.05 | 0.0035 | 0 | +2 | A | B | 1.02 |
| Example 8 | (1-6) | compound (10) | 0.20 | 0.0035 | −4 | +4 | A | B | 1.04 |
| Example 9 | (1-6) | compound (7) | 0.02 | 0.0035 | −1 | +3 | A | B | 1.00 |
| Example 10 | (1-6) | compound (10) | 0.25 | 0.0035 | −4 | +7 | A | B | 1.15 |
| Example 11 | (1-6) | compound (7) | 0.01 | 0.0034 | +1 | +1 | B | C | 1.00 |
| Example 12 | (1-6) | compound (11) | 0.01 | 0.0035 | 0 | +2 | B | C | 1.02 |
| Example 13 | (1-6) | compound (12) | 0.25 | 0.0035 | −1 | +9 | B | C | 1.30 |
| Example 14 | (1-6) | compound (13) | 0.01 | 0.0035 | −1 | +2 | C | C | 1.04 |
| Example 15 | (1-7) | compound (7) | 0.05 | 0.0044 | −3 | +12 | A | B | 0.86 |
| Example 16 | (1-1) | compound (7) | 0.05 | 0.0040 | −2 | +3 | A | A | 0.88 |
| Example 17 | (1-1) | compound (7) | 0.05 | 0.0040 | 0 | +2 | A | A | 1.25 |
| Example 18 | (1-1) | compound (7) | 0.05 | 0.0040 | 0 | +3 | A | A | 0.78 |
| Example 19 | (1-1) | compound (7) | 0.05 | 0.0040 | −1 | +3 | A | A | 0.85 |
| Example 20 | (1-1) | compound (7) | 0.05 | 0.0040 | −2 | +4 | A | B | 0.76 |
| Example 21 | (1-1) | compound (7) | 0.05 | 0.0040 | −1 | +3 | A | A | 1.12 |
| Example 22 | (1-1) | compound (7) | 0.05 | 0.0040 | −2 | +3 | A | B | 1.21 |
| Comparative example 1 | (1-5) | none | 0.00 | 0.0045 | −2 | +3 | D | D | 1.04 |
| Comparative example 2 | (1-5) | none | 0.00 | 0.0045 | −3 | +7 | B | D | 1.07 |
| Comparative example 3 | (1-5) | compound (14) | 0.05 | 0.0046 | −1 | +1 | C | D | 0.85 |

The invention claimed is:

1. An electrophotographic photosensitive member comprising:

an electroconductive support member; and a photosensitive layer on the electroconductive support member, wherein the surface layer of the electrophotographic photosensitive member contains a cured material, and the cured material is a copolymer of:

a hole transport compound having a chain-polymerizable functional group, and a compound denoted by a formula (I)

(I)

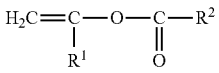

in the formula (I), $R^1$ represents a hydrogen atom or a methyl group, and $R^2$ represents a straight-chain alkyl group having a carbon number of 7 or more or a branched alkyl group having a carbon number of 7 or more.

2. The electrophotographic photosensitive member according to claim 1, wherein the chain-polymerizable functional group is a monovalent group having a structure denoted by a formula (II)

(II)

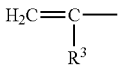

in the formula (II), $R^3$ represents a hydrogen atom or a methyl group.

3. The electrophotographic photosensitive member according to claim 1, wherein $R^2$ in the formula (I) represents a straight-chain alkyl group having a carbon number of 9 or more and 14 or less or a branched alkyl group having a carbon number of 9 or more and 14 or less.

4. The electrophotographic photosensitive member according to claim 3, wherein the value of $$\{Ma/(Ma+Mb)\}\times(Fa/M1)+\{Mb/(Ma+Mb)\}\times(1/M2)$$

is 0.0036 or more and 0.0044 or less, where the number of chain-polymerizable functional groups per molecule of the hole transport compound having a chain-polymerizable functional group is specified as Fa, the molecular weight of the hole transport compound having a chain-polymerizable functional group is specified as M1, the molecular weight of the compound denoted by the formula (I) is specified as M2, the mass of the hole transport compound having a chain-polymerizable functional group is specified as Ma, and the mass of the compound denoted by formula (I) is specified as Mb.

5. The electrophotographic photosensitive member according to claim 1, wherein the hole transport compound having a chain-polymerizable functional group is a compound denoted by a formula (III)

$$(P^1)_aZ \quad \text{(III)}$$

in the formula (III):

$P^1$ represents a monovalent group denoted by a formula (IV) or a monovalent group denoted by a formula (V), a represents an integer of 2 or more and 4 or less, in the case where a is 2 or more, each of the $P^1$s is the same or different from each other, Z represents a hole transport group, and a compound denoted by a formula (VI) or a compound denoted by a formula (VII) is a hydrogen adduct in which sites bonding to the $P^1$s of Z in the formula (III) are substituted with hydrogen atoms (IV)

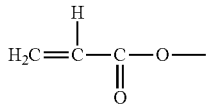

(V)

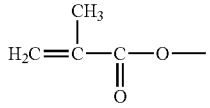

(VI)

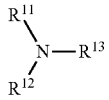

in the formula (VI), each of $R^{11}$ to $R^{13}$ represents a phenyl group or a phenyl group that has an alkyl group having a carbon number of 1 or more and 6 or less as a substituent (VII)

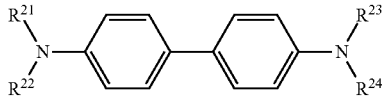

in the formula (VII), each of $R^{21}$ to $R^{24}$ represents a phenyl group or a phenyl group that has an alkyl group having a carbon number of 1 or more and 6 or less as a substituent.

6. The electrophotographic photosensitive member according to claim 1, wherein the cured material is a copolymer of:

a hole transport compound having a chain-polymerizable functional group, a compound denoted by the formula (I), and a siloxane-modified acrylic compound.

7. A method for manufacturing an electrophotographic photosensitive member, comprising the steps of:

preparing a surface layer coating liquid containing a hole transport compound having a chain-polymerizable functional group and a compound denoted by a formula (I), forming a film of the surface layer coating liquid, and forming a surface layer of the electrophotographic photosensitive member by curing the film (I)

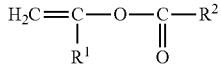

in the formula (I), $R^1$ represents a hydrogen atom or a methyl group, and $R^2$ represents a straight-chain alkyl group having a carbon number of 7 or more or a branched alkyl group having a carbon number of 7 or more.

8. The method for manufacturing an electrophotographic photosensitive member according to claim 7, wherein the chain-polymerizable functional group is a monovalent group having a structure denoted by a formula (II)

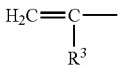

(II)

in the formula (II), $R^3$ represents a hydrogen atom or a methyl group.

9. The method for manufacturing an electrophotographic photosensitive member according to claim 7, wherein $R^2$ in the formula (I) represents a straight-chain alkyl group having a carbon number of 9 or more and 14 or less or a branched alkyl group having a carbon number of 9 or more and 14 or less.

10. The method for manufacturing an electrophotographic photosensitive member according to claim 7, wherein $0.02 \leq Mb/(Ma+Mb) \leq 0.20$, where the mass of the hole transport compound having a chain-polymerizable functional group contained in the surface layer coating liquid is specified as Ma, and the mass of the compound denoted by the formula (I) contained in the surface layer coating liquid is specified as Mb.

11. The method for manufacturing an electrophotographic photosensitive member according to claim 10, wherein the value of $$\{Ma/(Ma+Mb)\}\times(Fa/M1)+\{Mb/(Ma+Mb)\}\times(1/M2)$$

is 0.0036 or more and 0.0044 or less, where the number of chain-polymerizable functional groups per molecule of the hole transport compound having a chain-polymerizable functional group is specified as Fa, the molecular weight of the hole transport compound having a chain-polymerizable functional group is specified as M1, and the molecular weight of the compound denoted by the formula (I) is specified as M2.

12. The method for manufacturing an electrophotographic photosensitive member according to claim 7, wherein the forming of a surface layer of the electrophotographic photosensitive member includes the step of curing the film by irradiating the film with electron beams or ultraviolet rays.

13. The method for manufacturing an electrophotographic photosensitive member according to claims 12, wherein the forming of a surface layer of the electrophotographic photosensitive member includes the step of heating the film at a temperature of 100° C. or higher and 140° C. or lower after the film has been irradiated with the electron beams or ultraviolet rays.

14. A process cartridge that is detachably attached to an electrophotographic apparatus main body and integrally supports:

an electrophotographic photosensitive member, and at least one device selected from the group consisting of a charging device, a developing device, a transfer device, and a cleaning device, wherein the electrophotographic photosensitive member comprises:

an electroconductive support member; and a photosensitive layer on the electroconductive support member, wherein the surface layer of the electrophotographic photosensitive member contains a cured material, and the cured material is a copolymer of:

a hole transport compound having a chain-polymerizable functional group, and a compound denoted by a formula (I)

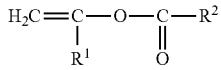

(I)

in the formula (I), $R^1$ represents a hydrogen atom or a methyl group, and $R^2$ represents a straight-chain alkyl group having a carbon number of 7 or more or a branched alkyl group having a carbon number of 7 or more.

15. An electrophotographic apparatus comprising an electrophotographic photosensitive member, a charging device, an exposure device, a developing device, and a transfer device, wherein the electrophotographic photosensitive member comprises:

an electroconductive support member; and a photosensitive layer on the electroconductive support member, wherein the surface layer of the electrophotographic photosensitive member contains a cured material, and the cured material is a copolymer of:

a hole transport compound having a chain-polymerizable functional group, and a compound denoted by a formula (I)

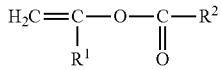

(I)

in the formula (I), $R^1$ represents a hydrogen atom or a methyl group, and $R^2$ represents a straight-chain alkyl group having a carbon number of 7 or more or a branched alkyl group having a carbon number of 7 or more.

16. The method for manufacturing an electrophotographic photosensitive member according to claim 7, wherein the film is a coating film formed on a photosensitive layer of the electrophotographic photosensitive member as a protective layer or formed on a charge generation layer of the electrophotographic photosensitive member as a charge transport layer.

* * * * *